US009984626B2

(12) United States Patent
Wu et al.

(10) Patent No.: US 9,984,626 B2
(45) Date of Patent: May 29, 2018

(54) PIXEL CIRCUIT FOR ORGANIC LIGHT EMITTING DIODE, A DISPLAY DEVICE HAVING PIXEL CIRCUIT AND DRIVING METHOD OF PIXEL CIRCUIT

(71) Applicant: BOE TECHNOLOGY GROUP CO., LTD., Beijing (CN)

(72) Inventors: Zhongyuan Wu, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 70 days.

(21) Appl. No.: 14/076,408

(22) Filed: Nov. 11, 2013

(65) Prior Publication Data

US 2014/0132642 A1 May 15, 2014

(30) Foreign Application Priority Data

Nov. 12, 2012 (CN) ..... 2012 1 0452120

(51) Int. Cl.
*G09G 3/32* (2016.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0842* (2013.01);
(Continued)

(58) Field of Classification Search
CPC ..... G09G 3/30; G09G 3/3208; G09G 3/3233; G09G 3/3258
(Continued)

(56) References Cited

U.S. PATENT DOCUMENTS

2005/0243076 A1 11/2005 Kim et al.
2006/0103322 A1* 5/2006 Chung ..... G09G 3/3233 315/169.3
(Continued)

FOREIGN PATENT DOCUMENTS

CN 1694135 A 11/2005
CN 1776794 A 5/2006
(Continued)

OTHER PUBLICATIONS

Second Chinese Office Action Appln. No. 201210452120.6; dated Sep. 23, 2014.
(Continued)

*Primary Examiner* — Long D Pham
(74) *Attorney, Agent, or Firm* — Ladas & Parry LLP; Loren K. Thompson

(57) ABSTRACT

The embodiments of the invention disclose a pixel circuit, a display device and a driving method thereof. The pixel circuit comprises a light-emitting element; a driving TFT, its drain is input a power supply voltage signal; a first TFT, its drain is connected with a source of the driving TFT, its source is connected with the light-emitting element, its gate receives a first control signal; a second TFT, its source receives a data signal, its drain is connected with a gate of the driving TFT, its gate receives a scanning signal; a third TFT, its source receives a reference voltage signal, its gate receives the scanning signal; a fourth TFT, its source is connected with a drain of the third TFT, its drain is connected with the gate of the driving TFT and the drain of the second TFT, its gate receives a second control signal; and a capacitor.

9 Claims, 4 Drawing Sheets

(52) U.S. Cl.
CPC ..... *G09G 2300/0861* (2013.01); *G09G 2300/0871* (2013.01); *G09G 2310/0251* (2013.01); *G09G 2320/045* (2013.01)

(58) Field of Classification Search
USPC ..... 345/76, 82
See application file for complete search history.

(56) References Cited

U.S. PATENT DOCUMENTS

| | | | | |
|---|---|---|---|---|
| 2006/0176251 | A1 | 8/2006 | Park et al. | |
| 2008/0048949 | A1 | 2/2008 | Kim | |
| 2010/0007645 | A1* | 1/2010 | Ono | 345/211 |
| 2010/0309187 | A1 | 12/2010 | Kang et al. | |
| 2011/0090200 | A1* | 4/2011 | Choi et al. | 345/211 |
| 2011/0164016 | A1* | 7/2011 | Kang et al. | 345/211 |
| 2014/0111562 | A1 | 4/2014 | Wu et al. | |

FOREIGN PATENT DOCUMENTS

| | | | |
|---|---|---|---|
| CN | 102651198 | A | 8/2012 |
| CN | 202917146 | U | 5/2013 |

OTHER PUBLICATIONS

First Chinese Office Action dated Apr. 18, 2014; Appln. No. 201210452120.6.

* cited by examiner

PIXEL CIRCUIT FOR ORGANIC LIGHT EMITTING DIODE, A DISPLAY DEVICE HAVING PIXEL CIRCUIT AND DRIVING METHOD OF PIXEL CIRCUIT

TECHNICAL FIELD

Embodiments of the present invention relate to a field of display, and in particular to a pixel circuit, a display device and a driving method of the pixel circuit.

BACKGROUND

An organic light emitting diode (OLED) is an active light emitting device driven by a current. Due to its unique characteristics of a self-light emitting, a quick response, a wide angle of view and being manufaturable on a flexible substrate and the like, an organic light emitting display based on the OLED is predicted to become a mainstream of the display field over the next few years.

Each display unit in the organic light emitting display is composed of the OLED. The organic light emitting display may be divided into an active organic light emitting display and a passive organic light emitting display according to their driving modes, wherein the active organic light emitting display refers to that, for each OLED, a current flowing through the OLED is controlled by a thin film transistor (TFT) circuit, and the OLED and the TFT circuit for driving the OLED are composed of a pixel circuit.

A typical pixel circuit is as shown in FIG. 1, comprising two TFT transistors, one capacitor and one OLED, wherein a switching transistor T2 transmits voltage on a data line to a gate of a driving transistor T1, and the driving transistor T1 in turn converts this data voltage into a corresponding current to be supplied to the OLED device. The corresponding current can be expressed as an Equation as follows:

$$I_{OLED} = \frac{1}{2}\mu_n \cdot Cox \cdot \frac{W}{L} \cdot (Vgs - Vth)^2 = \frac{1}{2}\mu_n \cdot Cox \cdot \frac{W}{L} \cdot (Vdata - Voled - Vth)^2 \quad (1)$$

Wherein Vgs is a potential difference between a gate and a source of the driving transistor T1, $\mu_n$ is a carrier mobility, Cox is a capacitance of an insulation layer of the gate, W/L is a width-length ratio of the transistor, Vdata is a data voltage, Voled is an operating voltage on the OLED, and Vth is a threshold voltage of the driving transistor T1. It can be known from the Equation (1) that: if the Vths are different among different pixel units or the Vth drifts as time lapses, then there are variances in the currents flowing through the OLEDs, thus influencing a display effect. In addition, when the operating voltages of the OLEDs are different due to a non-uniformity of the OLED devices, variances in the currents may be occurred too.

At present, there are many kinds of pixel circuits for compensating the variances in the currents caused by the non-uniformity, the drift of the threshold voltages Vth and the non-uniformity of the OLEDs, but these kinds of pixel circuits are generally realized by disposing the drive TFT in a manner of a diode connection as shown in FIG. 2, but such structure is only applicable to an enhancement type TFT. For a depletion type TFT, it may still be turned on in a case of Vgs=0, therefore voltages stored in the TFT do not comprise any information on the threshold voltage Vth. As a result, for the depletion type TFT, the existing pixel circuits are unable to compensate the variances in the currents caused by the non-uniformity of the threshold voltage.

SUMMARY

A technical problem to be solved by the embodiments of the present invention is to provide a pixel circuit, a display device and a driving method of the pixel circuit, which may effectively compensate the variances in the currents caused by a non-uniformity, a drift of threshold voltage in the depletion type or enhancement type TFT driving transistors and the non-uniformity of the OLEDs, thus enhancing a display effect of the display device.

In order to achieve the object, embodiments of the present invention adopt following technical solutions.

A pixel circuit, comprising:

a light-emitting element;

a driving thin film transistor for driving the light-emitting element, wherein a drain thereof is input a power supply voltage signal;

a first thin film transistor, wherein a source thereof is connected with the light-emitting element, a drain thereof is connected with a source of the drive thin film transistor, and a gate thereof receives a first control signal;

a second thin film transistor, wherein a source thereof receives a data signal, a drain thereof is connected with a gate of the drive thin film transistor, and a gate thereof receives a scanning signal;

a third thin film transistor, wherein a source thereof receives a reference voltage signal, and a gate thereof receives the scanning signal;

a fourth thin film transistor, wherein a source thereof is connected with a drain of the third thin film transistor, a drain thereof is connected with the gate of the drive thin film transistor and the drain of the second thin film transistor, and a gate thereof receives a second control signal; and a capacitor, wherein one electrode plate of the capacitor is connected to a first node and the other electrode plate is connected to a second node, wherein the first node is a connection point between the drain of the first thin film transistor and the source of the driving thin film transistor, and the second node is a connection point between the source of the fourth thin film transistor and the drain of the third thin film transistor.

The driving thin film transistor is a N type thin film transistor.

Optionally, the thin film transistors are depletion type thin film transistors or enhancement type thin film transistors.

Optionally, the light-emitting element is an organic light emitting diode.

The embodiments of the present invention further provide a display device on which any one of the pixel circuits is disposed.

On the other hand, the embodiments of the present invention further provide a driving method applicable to the pixel circuits, comprising:

a precharging stage, during which the scanning signal turns on the second and third thin film transistors, the data signal is input to the gate of the driving thin film transistor such that the driving thin film transistor is turned off, and at the same time, the second control signal turns off the fourth thin film transistor, the first control signal turns on the first thin film transistor, charges stored at the first node are discharged through the light-emitting element, and a voltage at the first node drops;

a compensating stage, during which the second and third thin film transistors go on to be kept in an ON state, the data signal is input to the gate of the driving thin film transistor and turns on the driving thin film transistor, and at the same time, the fourth thin film transistor goes on to be kept in an OFF state, the first control signal turns off the first thin film transistor, and the power supply voltage signal charges the first node through the driving thin film transistor, such that the voltage at the first node increases; and a keeping light-emitting stage, during which the scanning signal turns off the second and third thin film transistors, the driving thin film transistor goes on to be kept in the ON state, and at the same time, the second control signal turns on the fourth thin film transistor, the first control signal turns on the first thin film transistor, the capacitor keeps a gate-source voltage of the driving thin film transistor be unchanged, and the thin film transistor drives the light-emitting element to emit light.

The pixel circuit, the display device and the driving method of the pixel circuit according to the embodiments of the present invention connect one end of the capacitor to the source (the first node) of the driving thin film transistor, connect the other end to the gate of the driving thin film transistor and a reference voltage, and control whether the capacitor is connected to the gate of the driving thin film transistor or the reference voltage through the fourth thin film transistor and the third thin film transistor, respectively. A display process for each frame image comprises three stages of precharging, compensating and keeping light-emitting. During the precharging stage: the first thin film transistor is turned on, and the charges stored at the first node are discharged, such that the voltage at the first node is pulled down. During the compensating stage: the third and fifth thin film transistors are turned on to charge the first node. As a result, the voltage at the first node comprises the information on the threshold voltage of the driving thin film transistor. During the keeping light-emitting stage: the fourth thin film transistor is turned on, the capacitor is connected between the gate and source of the driving thin film transistor, the gate-source voltage of the driving thin film transistor is kept unchanged, the driving thin film transistor drives the light-emitting element to emit light, and its current is independent of the threshold voltage of the driving thin film transistor and the voltage across the two terminals of the light-emitting element. Therefore, the variances in the currents caused by the non-uniformity, the drift of threshold voltage in the depletion type or enhancement type driving TFT and the non-uniformity of the OLED may be effectively compensated, thus may enhance the display effect of the display device.

DETAILED DESCRIPTION

Embodiments of the present invention provide a pixel circuit, a display device and a driving method of the pixel circuit, which may effectively compensate the variances in the currents caused by the non-uniformity, the drift of threshold voltage in the depletion type or enhancement type driving TFT and the non-uniformity of the OLED, thus may enhance the display effect of the display device.

Below the embodiments of the present invention will be described in details in combination with the accompanying drawings. The specific implementations described herein are only used to explain the present invention but not to limit the present invention.

Figure 3:
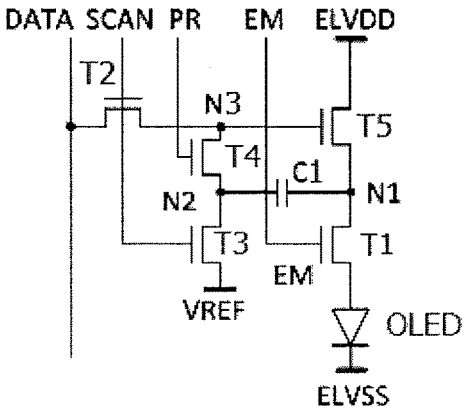
FIG. 3 is a first schematic diagram illustrating the pixel circuit provided in an embodiment of the present invention.

It needs to note that there is no explicit distinction between a drain and a source for transistors in the field of the liquid crystal display, therefore the source of the transistors mentioned in the embodiments of the present invention may be the drain of the transistors, and the drain of the transistors in turn may be the source of the transistors. An embodiment of the present invention provides a pixel circuit. As shown in FIG. 3, the pixel circuit comprises:

a light-emitting element;

a driving thin film transistor T5 for driving the light-emitting element, wherein a drain thereof is input a power supply voltage signal ELVDD;

a first thin film transistor T1, wherein a source thereof is connected with the light-emitting element, a drain thereof is connected with a source of the driving thin film transistor T5, and a gate thereof receives a first control signal EM;

a second thin film transistor T2, wherein a source thereof receives a data signal DATA, a drain thereof is connected with a gate of the driving thin film transistor T5, and a gate thereof receives a scanning signal SCAN;

a third thin film transistor T3, wherein a source thereof receives a reference voltage signal VREF, and a gate thereof receives the scanning signal SCAN;

a fourth thin film transistor T4, wherein a source thereof is connected with a drain of the third thin film transistor T3, a drain thereof is connected with the gate of the driving thin film transistor T5 and the drain of the second thin film transistor T2, and a gate thereof receives a second control signal PR; and a capacitor C1, wherein one electrode plate thereof is connected to a first node N1 and the other electrode plate thereof is connected to a second node N2, wherein the first node N1 is a connection point between the drain of the first thin film transistor T1 and the source of the driving thin film transistor T5, and the second node N2 is a connection point between the source of the fourth thin film transistor T4 and the drain of the third thin film transistor T3.

The pixel circuit described above in the embodiment of the present invention is composed of five thin film transistors and one capacitor, wherein in an example the driving thin film transistor T5 is a N type thin film transistor; in addition, the driving thin film transistor T5 may be selected as either a depletion type thin film transistor or an enhancement type thin film transistor.

According to the embodiment of the present invention, no matter whether the driving thin film transistor T5 in a compensation circuit is the depletion type thin film transistor or the enhancement type thin film transistor, the variances in the currents caused by the non-uniformity, the drift of threshold voltage in the driving thin film transistor and the non-uniformity of the OLED may be effectively compensated.

Further, the thin film transistors other than the driving thin film transistor T5 only function as switches, may be either N type thin film transistors or P type thin film transistors, and may be either the depletion type thin film transistors or the enhancement type thin film transistors, no limitation made thereto.

Therefore, in the embodiment of the present invention, detailed models of respective thin film transistors (that is, whether the respective thin film transistors are the N type or the P type, whether the depletion type or the enhancement type) cannot be used to limit the compensation circuit. Changements in model selections for the respective thin film transistors and connection changes due to changements in the model selections for those skilled in the art without any inventive labors will also be regarded as falling into the scope of the present invention.

All of the five thin film transistors (T1-T5) shown in FIG. 3 are N type thin film transistors. For convenience of manufacturing, in an example, the N type thin film transistors with a same standard are adopted. In a further example, the driving thin film transistor T5 may be a N type depletion thin film transistor, or also may be a N type enhancement thin film transistor (see the following description for detailed compensating process). Wherein, in an example, the light-emitting element is an organic light emitting diode (OLED).

The pixel circuit provided in the present embodiment may effectively compensate the variances in the currents caused by the non-uniformity, the drift of threshold voltage in the depletion type or enhancement type TFT and the non-uniformity of the OLED (see the following description for detailed principles), thus may enhance the display effect of the display device. Below principles of the specific operating process for the pixel circuit will be discussed in detailed.

Figure 4:
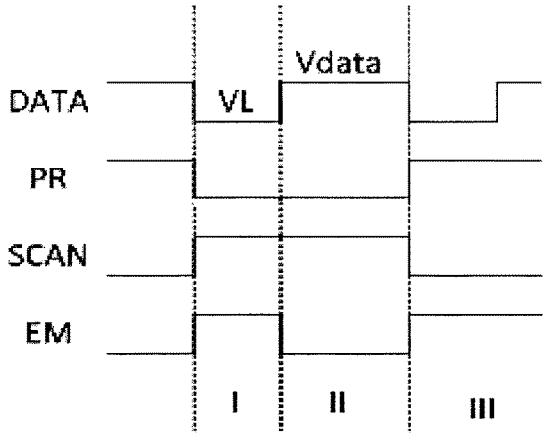
FIG. 4 is a control timing chart of the pixel circuit according to an embodiment of the present invention.
Figure 5:
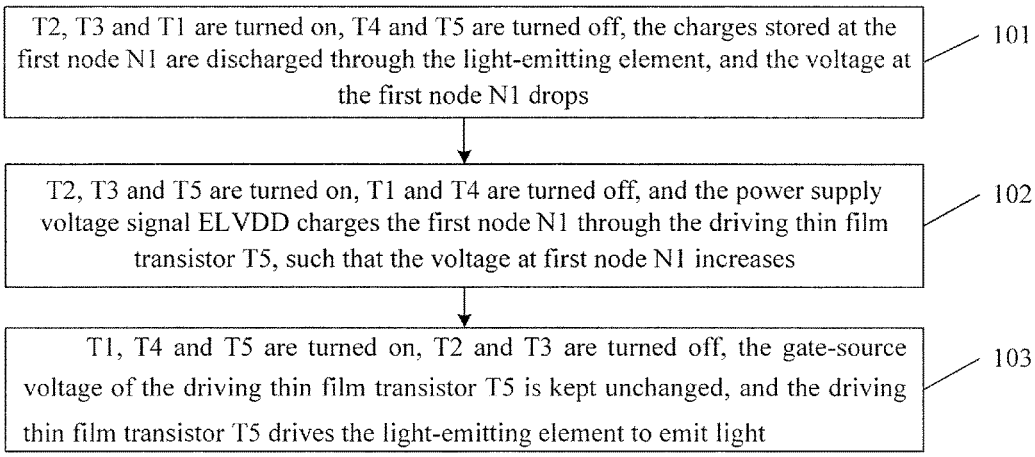
FIG. 5 is a flow chart illustrating a driving method of the pixel circuit according to an embodiment of the present invention.

The pixel circuit adopts a control timing chart as shown in FIG. 4, and a display process for each frame of images comprises three stages of precharging (I), compensating (II) and keeping light-emitting (III). As shown in FIG. 5, it particularly comprises the following steps.

In step 101, during the precharging stage (I), the scanning signal SCAN turns on the second thin film transistor T2 and the third thin film transistor T3, and the data signal DATA is input to the gate of the driving thin film transistor T5, such that the driving thin film transistor T5 is turned off, and at the same time, the second control signal PR turns off the fourth thin film transistor T4, the first control signal EM turns on the first thin film transistor T1, charges stored at the first node N1 are discharged through the light-emitting element OLED, and a voltage at the first node N1 drops.

During the precharging stage (I), the scanning SCAN and the first control signal EM are at a high level, the second control signal PR is at a low level, and the data signal DATA outputs a low voltage signal (VL). At this time, among the five thin film transistors, the T2, T3 and T1 are turned on, the T4 is turned off, the low voltage signal (VL) in the data signal DATA turns off the driving thin film transistor T5, the charges stored at the first node N1 are discharged through the light-emitting element OLED (actually, the thin film transistor T1 is turned on and the capacitor C1 is discharged), and the voltage at the first node N1 drops until the voltage at the first node N1 reaches VL−Vth, wherein VL is a gate voltage of the driving thin film transistor T5 at this time and Vth is a threshold voltage of the thin film transistor T5. In order to ensure the loading of the data signal, it may guarantee that a voltage value of VL−Vth is lower than a driving voltage for the minimum gray scale in the design.

Figure 6:
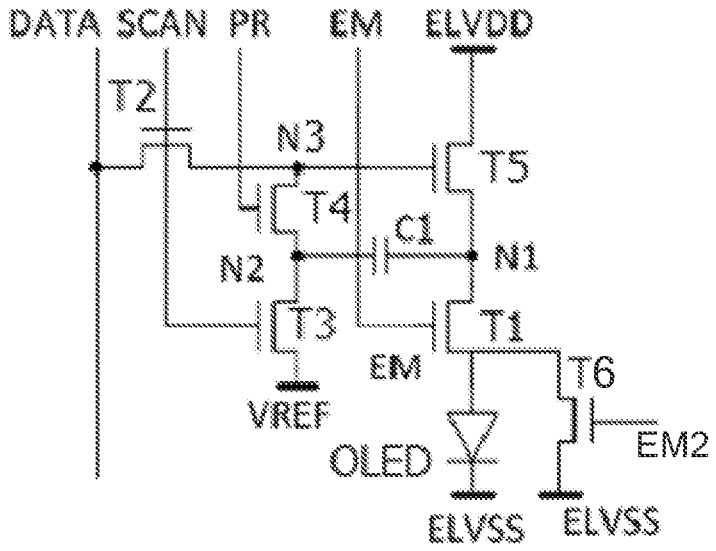
FIG. 6 is a second schematic diagram illustrating the pixel circuit provided in an embodiment of the present invention.

In the process of the precharging stage (I), some charges may flow through the light-emitting element OLED and may in turn influence the light-emitting element. In order to ensure that a current flows through the OLED only during a light emitting stage, in an example, as shown in FIG. 6, a thin film transistor T6 and a control signal EM2 for controlling a turning-on of the thin film transistor T6 may be added across two ends of the OLED. A drain of the thin film transistor T6 is grounded, and the thin film transistor T6 is controlled to be turned on by the control signal EM2 so as to discharge the charges stored at the first node N1 during the precharging stage, so that a useful life of the OLED may be increased.

In step 102, during the compensating stage (II), the second thin film transistor T2 and the third thin film transistor T3 go on to be kept in a ON state, the data signal DATA is input to the gate of the driving thin film transistor so as to turn on the driving thin film transistor T5, and at the same time, the fourth thin film transistor T4 goes on to be kept in a OFF state, the first control signal EM turns off the first thin film transistor T1, and the power supply voltage signal ELVDD charges the first node N1 through the driving thin film transistor T5, such that the voltage at the first node N1 increases.

During the compensating stage (II), the scanning signal SCAN is still at the high level, the second and third thin film transistors T2 and T3 go on to be kept in the ON state; the second control signal PR is still at the low level, and the fourth thin film transistor T4 goes on to be kept in the OFF state; the first control signal EM is at the low level, and the first thin film transistor T1 is turned off; the data signal DATA is a data voltage Vdata (a driving voltage of gray scale) of a current image frame and is input to the gate of the thin film transistor T5, the voltage at the first node N1 of the driving thin film transistor T5 is kept as the voltage VL−Vth just as the precharging stage (I) ends, and the gate-source voltage, of the driving thin film transistor T5, Vgs=Vdata+Vth−VL. Because Vdata>VL, then Vgs>Vth, so that the driving thin film transistor T5 is turned on. At this time, the power supply voltage signal ELVDD charges the first node N1 through the driving thin film transistor T5 (actually, the driving thin film transistor T5 is turned on to charge the capacitor C1) until the voltage at the first node N1 is equal to Vdata−Vth. It shall be noted that this compensation process is independent of a positive or negative of the threshold voltage Vth. Since ELVDD>Vdata, the source of the driving thin film transistor T5 may be charged up to Vdata−Vth. At this time, the gate-source voltage, of the driving thin film transistor T5, Vgs=Vdata−(Vdata−Vth)=Vth, such that the driving thin film transistor T5 is at a critical turning-on point. Accordingly, the voltage at the first node N1 may reach Vdata−Vth no matter whether the driving thin film transistor T5 is a depletion type thin film transistor or an enhancement type thin film transistor. Therefore, the pixel circuit provided in the embodiment of the present invention is applicable to both the enhancement type driving TFT and the depletion type driving TFT, and may effectively compensate the variances in the currents caused by the non-uniformity, the drift of threshold voltage in the driving TFT and the non-uniformity of the OLED, thus its applicability is wider.

When the compensating stage (II) ends, a charge quantity Q of the capacitor C1 may be expressed as an Equation as follows:

$$Q=C(V2-V1)=C\cdot(VREF+Vth-Vdata) \quad (2)$$

Wherein V1 is the voltage at the first node N1 at this time and is equal to Vth−Vdata; and V2 is the voltage at the second node N2 at this time and is equal to the reference voltage VREF.

In step 103, during the keeping light-emitting stage (III), the scanning signal SCAN turns off the second thin film transistor T2 and the third thin film transistor T3, the driving thin film transistor T5 goes on to be kept in the ON state, and at the same time, the second control signal PR turns on the fourth thin film transistor T4, the first control signal EM turns on the first thin film transistor T1, the capacitor C1 keeps the gate-source voltage of the driving thin film transistor T5 unchanged, and the thin film transistor drives the light-emitting element to emit light.

During the keeping light-emitting stage (III), the scanning signal SCAN is at the low level, and the second control signal PR and the first control signal EM are at the high level. Thus, the second thin film transistor T2 and the third thin film transistor T3 are turned off, the first thin film transistor T1 and the fourth thin film transistor T4 are turned on, the capacitor C1 is connected between the gate and the source of the driving thin film transistor T5, the charges stored in the capacitor C1 is kept unchanged, and the gate-source voltage Vgs of the driving thin film transistor T5 is also kept unchanged. Therefore, the driving thin film transistor T5 is kept being turned on to driving the OLED to emit light. As the current in the OLED trends to be stable, the voltage at the first node N1 becomes the voltage Voled across the OLED. Due to a bootstrap effect of the capacitor C1, $$V2-Voled=VREF+Vth-Vdata$$

$$V2=Voled-Vdata+VREF+Vth \quad (3)$$

The fourth thin film transistor T4 is turned on, therefore the voltages at both the second node N2 and the third node N3 become: Voled−Vdata+VREF+Vth.

The gate-source voltage Vgs of the driving thin film transistor T5 is kept as VREF+Vth−Vdata. At this time, the current in the driving thin film transistor T5 may be expressed as an Equation as follows:

$$\begin{aligned} I_{OLED} &= \frac{1}{2}\cdot\mu_n\cdot Cox\cdot\frac{W}{L}\cdot[VREF-Vdata+Vth-Vth]^2 \\ &= \frac{1}{2}\cdot\mu_n\cdot Cox\cdot\frac{W}{L}\cdot[VREF-Vdata]^2 \end{aligned} \quad (4)$$

Wherein $\mu_n$ is a carrier mobility, Cox is a capacitance of an insulation layer of the gate, and W/L is a width-length ratio of the transistor. It can be known from the Equation (4) that the current in the driving thin film transistor T5 is only dependent of the reference voltage VREF and the data voltage Vdata, but is independent of the threshold voltage Vth and the voltage Voled across the OLED. Therefore, the influence caused by the non-uniformity and the drift of the threshold voltage in the driving thin film transistor T5 and the non-uniformity in the electric performance of the OLED may be eliminated.

Figure 7:
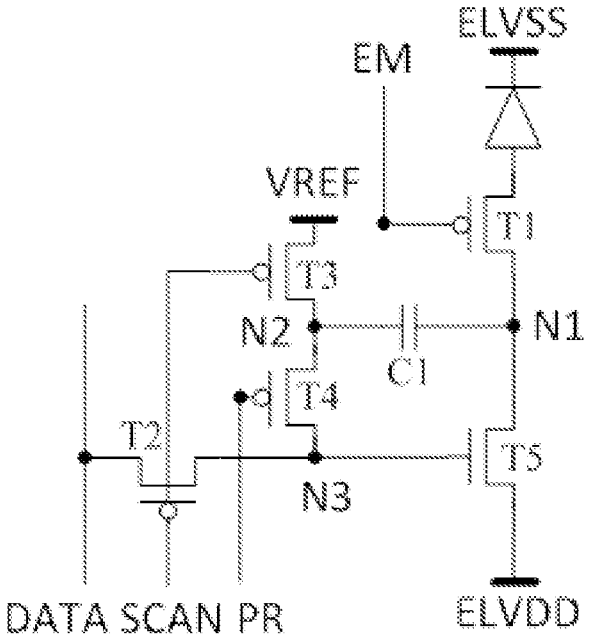
FIG. 7 is a schematic diagram of another pixel circuit according to an embodiment of the present invention.
Figure 8:
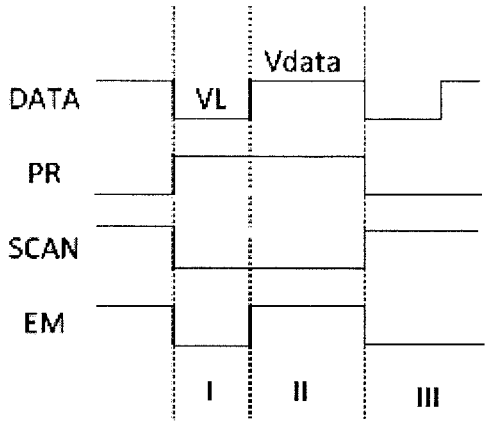
FIG. 8 is a control timing chart of another pixel circuit according to an embodiment of the present invention.

In a second specific implementation of the present embodiment, as shown in FIG. 7, in the pixel circuit, the four thin film transistors (T1-T4) are P type thin film transistors and the driving thin film transistor T5 is still the N type thin film transistor. A control timing chart of the circuit diagram is as shown in FIG. 8. All of the scanning signal SCAN, the first control signal EM and the second control signal PR have opposite control timings to those in FIG. 4, except for the data signal DATA. Besides, a specific operation process of this pixel circuit and its compensation process are almost similar, so details omitted.

Figure 1:
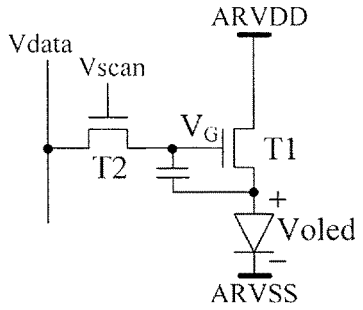
FIG. 1 is a schematic diagram illustrating a structure of an existing pixel circuit.
Figure 2:
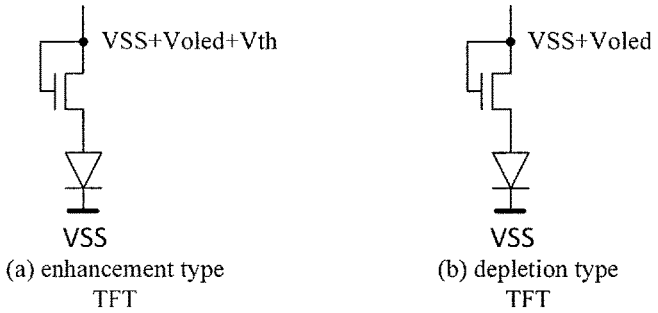
FIG. 2 is a schematic diagram illustrating a principle of a compensating method of the existing pixel circuit.

A compensating function of the existing pixel circuit is generally realized by disposing the driving TFT in a manner of a diode connection as shown in FIG. 2, but such structure is only applicable to an enhancement type TFT. For a depletion type TFT, it may still be turned on in a case of Vgs=0, therefore voltages stored in the TFT do not comprise any information on the threshold voltage Vth. As a result, for the depletion type TFT, the existing pixel circuits are unable to compensate the variances in the currents caused by the non-uniformity of the threshold voltage.

As compared, it can be seen from the above process that the pixel circuit provided in the embodiments of the present invention performs the compensation by using the storage voltage of the capacitor C1, which comprises the information on the threshold voltage Vth. During the compensation voltage (II), because ELVDD>Vdata, the source of the driving thin film transistor T5 may be charged up to Vdata−Vth, and at this time, the gate-source voltage, of the driving thin film transistor T5, Vgs=Vdata−(Vdata−Vth)=Vth, such that the driving thin film transistor T5 is at the critical turning-on point, and the voltage at the first node N1 is equal to Vdata−Vth. Further, such compensating process is independent of a polarity of the threshold voltage Vth. Therefore, the voltage at the first node N1 may reach Vdata−Vth no matter whether the driving thin film transistor T5 is the depletion type thin film transistor or the enhancement type thin film transistor. During the keeping light emitting stage (III), the charges stored in the capacitor C1 is unchanged and the gate-source voltage Vgs of the driving thin film transistor T5 is also kept as VREF−(Vdata−Vth), which is unchanged, so that the current in the driving thin film transistor T5 is only dependent of the reference voltage and the data voltage but is independent of the threshold voltage Vth and the voltage Voled across the OLED.

Therefore, the pixel circuit provided in the embodiments of the present invention is applicable to both the enhancement type TFT and the depletion type TFT, and may effectively compensate the variances in the currents caused by the non-uniformity, the drift of threshold voltage in the TFT and the non-uniformity of the OLED, so that its applicability is wider.

The embodiments of the present invention further provide a display device on which any one of the pixel circuits as described above is disposed. The pixel circuit may effectively compensate the variances in the currents caused by the non-uniformity, the drift of threshold voltage in the driving TFT and the non-uniformity of the OLED, thereby the display device of the present embodiment has a uniform luminance and a better display effect. The display device may be a liquid crystal panel, a piece of electronic paper, an OLED panel, a mobile phone, a panel computer, a television, a display, a notebook computer, a digital photo frame, a navigator and any other product or means having a display function.

The technical features as recited in the embodiments of the present invention can be used by combining with each other in any random way in a case of no conflict.

The above are only specific embodiments of the present invention, but the scope sought for protection in the present invention is not limited thereto. Any modification or replacement that can be easily conceived by those skilled in the art within the technical scope disclosed in the present invention shall be fallen into the protection scope of the present invention. Therefore, the protection scope shall be subject to the protection scope of the Claims.

What is claimed is:

1. A pixel circuit, wherein the pixel circuit, comprising:

a light-emitting element;

a driving thin film transistor for driving the light-emitting element, wherein a drain thereof is input a power supply voltage signal;

a first thin film transistor, wherein a source thereof is connected with the light-emitting element, a drain thereof is connected with a source of the driving thin film transistor, and a gate thereof receives a first control signal;

a second thin film transistor, wherein a source thereof receives a data signal, a drain thereof is connected with a gate of the driving thin film transistor, and a gate thereof receives a scanning signal;

a third thin film transistor, wherein a source thereof receives a reference voltage signal, and a gate thereof receives the scanning signal;

a fourth thin film transistor, wherein a source thereof is connected with a drain of the third thin film transistor, a drain thereof is connected with the gate of the driving thin film transistor and the drain of the second thin film transistor, and a gate thereof receives a second control signal; and a capacitor, wherein one electrode plate thereof is connected to a first node and the other electrode plate thereof is connected to a second node, wherein the first node is a connection point between the drain of the first thin film transistor and the source of the driving thin film transistor, and the second node is a connection point between the source of the fourth thin film transistor and the drain of the third thin film transistor, during a keeping light-emitting stage, the capacitor is connected between the gate and the source of the driving thin film transistor, and wherein the second thin film transistor and the third thin film transistor are the same N-type thin film transistors or P-type thin film transistors, and wherein a difference between a level of the power supply voltage signal and a threshold voltage of the driving thin film transistor is lower than a predetermined level, wherein the scanning signal is inverted compared to the second control signal during all the phases.

2. The pixel circuit according to claim 1, wherein the driving thin film transistor is a N type thin film transistor.

3. The pixel circuit according to claim 1, wherein the thin film transistors are depletion type thin film transistors or enhancement type thin film transistors.

4. The pixel circuit according to claim 1, wherein the light-emitting element is an organic light emitting diode.

5. A display device, on which a pixel circuit is disposed, wherein the pixel circuit comprises:

a light-emitting element;

a driving thin film transistor for driving the light-emitting element, wherein a drain thereof is input a power supply voltage signal;

a first thin film transistor, wherein a source thereof is connected with the light-emitting element, a drain thereof is connected with a source of the driving thin film transistor, and a gate thereof receives a first control signal;

a second thin film transistor, wherein a source thereof receives a data signal, a drain thereof is connected with a gate of the driving thin film transistor, and a gate thereof receives a scanning signal;

a third thin film transistor, wherein a source thereof receives a reference voltage signal, and a gate thereof receives the scanning signal;

a fourth thin film transistor, wherein a source thereof is connected with a drain of the third thin film transistor, a drain thereof is connected with the gate of the driving thin film transistor and the drain of the second thin film transistor, and a gate thereof receives a second control signal; and a capacitor, wherein one electrode plate thereof is connected to a first node and the other electrode plate thereof is connected to a second node, wherein the first node is a connection point between the drain of the first thin film transistor and the source of the driving thin film transistor, and the second node is a connection point between the source of the fourth thin film transistor and the drain of the third thin film transistor, during a keeping light-emitting stage, the capacitor is connected between the gate and the source of the driving thin film transistor, and wherein the second thin film transistor and the third thin film transistor are the same N-type thin film transistors or P-type thin film transistors, and wherein a difference between a level of the power supply voltage signal and a threshold voltage of the driving thin film transistor is lower than a predetermined level, wherein the scanning signal is inverted compared to the second control signal during all the phases.

6. The display device according to claim 5, wherein the driving thin film transistor is a N type thin film transistor.

7. The display device according to claim 5, wherein the thin film transistors are depletion type thin film transistors or enhancement type thin film transistors.

8. The display device according to claim 5, wherein the light-emitting element is an organic light emitting diode.

9. A driving method applied to a pixel circuit, comprising:

a precharging stage, during which a scanning signal turns on a second and a third thin film transistors, and a data signal is input to a gate of a driving thin film transistor, such that the driving thin film transistor is turned off, and at the same time, a second control signal turns off a fourth thin film transistor, a first control signal turns on a first thin film transistor, charges stored at a first node are discharged through a light-emitting element, and a voltage at the first node drops;

a compensating stage, during which the second and third thin film transistors go on to be kept in an on state, the data signal is input to a gate of the driving thin film transistor and turns on the driving thin film transistor, and at the same time, the fourth thin film transistor goes on to be kept in an off state, the first control signal turns off the first thin film transistor, and a power supply voltage signal charges the first node through the driving thin film transistor, such that the voltage at the first node increases; and a keeping light-emitting stage, during which the scanning signal turns off the second and third thin film transistors, the driving thin film transistor goes on to be kept in the ON state, and at the same time, the second control signal turns on the fourth thin film transistor, the first control signal turns on the first thin film transistor, a capacitor keeps a gate-source voltage of the driving thin film transistor unchanged, and the driving thin film transistor drives the light-emitting element to emit light, wherein the pixel circuit comprises:

the light-emitting element;

the driving thin film transistor for driving the light-emitting element, wherein the drain thereof is input the power supply voltage signal;

the first thin film transistor, wherein a source thereof is connected with the light-emitting element, a drain thereof is connected with a source of the driving thin film transistor, and a gate thereof receives the first control signal;

the second thin film transistor, wherein a source thereof receives the data signal, a drain thereof is connected with the gate of the driving thin film transistor, and a gate thereof receives the scanning signal;

the third thin film transistor, wherein a source thereof receives a reference voltage signal, and a gate thereof receives the scanning signal;

the fourth thin film transistor, wherein a source thereof is connected with a drain of the third thin film transistor, a drain thereof is connected with the gate of the driving thin film transistor and the drain of the second thin film transistor, and a gate thereof receives the second control signal; and the capacitor, wherein one electrode plate thereof is connected to the first node and the other electrode plate thereof is connected to a second node, wherein the first node is a connection point between the drain of the first thin film transistor and the source of the driving thin film transistor, and the second node is a connection point between the source of the fourth thin film transistor and the drain of the third thin film transistor, during the keeping light-emitting stage, the capacitor is connected between the gate and the source of the driving thin film transistor, and wherein the second thin film transistor and the third thin film transistor are the same N-type thin film transistors or P-type thin film transistors, and wherein a difference between a level of the power supply voltage signal and a threshold voltage of the driving thin film transistor is lower than a predetermined level, wherein the scanning signal is inverted compared to the second control signal during all the phases.

* * * * *